US007077139B2

(12) United States Patent
Amante et al.

(10) Patent No.: US 7,077,139 B2
(45) **Date of Patent: *Jul. 18, 2006**

(54) DISPOSABLE FACE MASK

(75) Inventors: Michael A. Amante, Arlington, VA (US); Daryl S. Bell, Appleton, WI (US); Naveen Agarwal, Evansville, IN (US); Jeffrey M. Willis, Atlanta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 37 days.

This patent is subject to a terminal disclaimer.

(21) Appl. No.: 10/847,772

(22) Filed: May 18, 2004

(65) Prior Publication Data

US 2004/0216744 A1 Nov. 4, 2004

Related U.S. Application Data

(63) Continuation of application No. 10/325,262, filed on Dec. 19, 2002, now Pat. No. 6,941,949.

(51) Int. Cl.
*A62B 18/02* (2006.01)

(52) U.S. Cl. ..... 128/206.21; 128/207.11

(58) Field of Classification Search ..... 128/201.13, 128/201.23, 206.13, 206.21, 206.27, 207.11
See application file for complete search history.

(56) References Cited

U.S. PATENT DOCUMENTS

| | | | |
|---|---|---|---|
| 879,391 | A | 2/1908 | Leonard |
| 911,476 | A | 2/1909 | Cheesman |
| 1,224,039 | A | 4/1917 | Synohubyk |
| 1,344,349 | A | 6/1920 | Mickelso |
| 1,606,531 | A | 11/1926 | Ridgeway |
| 2,353,643 | A | 7/1944 | Bulbulian |
| 2,354,840 | A | 8/1944 | Seletz |
| 2,379,493 | A | 7/1945 | Morehouse |
| 2,507,447 | A | 5/1950 | La Joie |
| 2,634,725 | A | 4/1953 | Lo Presti |
| 2,667,869 | A | 2/1954 | Elias |
| 2,810,385 | A | 10/1957 | Reed |
| 3,040,741 | A | 6/1962 | Carolan |
| 3,058,463 | A | 10/1962 | Goodrich, Jr. |
| 3,117,574 | A | 1/1964 | Replogle |
| 3,234,939 | A | 2/1966 | Morton, Jr. |
| 3,664,335 | A | 5/1972 | Boucher et al. |
| D224,277 | S | 7/1972 | Venaleck |
| 3,929,135 | A | 12/1975 | Thompson |
| 4,084,585 | A | 4/1978 | Venaleck |
| 4,195,629 | A | 4/1980 | Halford |
| 4,196,728 | A | 4/1980 | Granite |
| 4,300,240 | A | 11/1981 | Edwards |
| 4,473,071 | A | 9/1984 | Hunt |
| 4,536,440 | A | 8/1985 | Berg |
| 4,573,271 | A | 3/1986 | Reed |
| 4,635,628 | A | 1/1987 | Hubbard et al. |
| 4,662,005 | A | 5/1987 | Grier-Idris |
| 4,671,268 | A | 6/1987 | Hunt |
| 4,671,271 | A | 6/1987 | Bishop et al. |

(Continued)

*Primary Examiner*—Aaron J. Lewis
(74) *Attorney, Agent, or Firm*—Sue C. Watson

(57) ABSTRACT

A disposable face mask includes a mask body covering substantially a nose, mouth, and chin of a wearer, and an extension provided with the mask body. The extension is configured to encircle a back of a wearer's head and to substantially cover a wearer's cheeks, jaw, and ears. A substantial portion of the extension is formed from a resilient material treated with a repellant agent to prevent contaminants from entering or exiting such treated portion of the extension.

15 Claims, 3 Drawing Sheets

U.S. PATENT DOCUMENTS 4,729,371 A 3/1988 Krueger et al.
4,790,307 A 12/1988 Haber et al.
D300,571 S 4/1989 Waters, Jr.
4,920,960 A 5/1990 Hubbard et al.
4,969,457 A 11/1990 Hubbard et al.
5,035,006 A 7/1991 Hetz et al.
5,116,682 A 5/1992 Chakravarti et al.
5,145,727 A 9/1992 Potts et al.
5,151,321 A 9/1992 Reeves et al.
5,265,280 A 11/1993 Walsh
5,467,765 A 11/1995 Maturaporn
5,511,541 A 4/1996 Dearstine
5,542,128 A 8/1996 Lomas
5,561,863 A 10/1996 Carlson, II
5,595,174 A 1/1997 Gwaltney
5,628,308 A 5/1997 Harges et al.
5,701,892 A 12/1997 Bledstein
5,704,068 A 1/1998 Martin
5,706,802 A * 1/1998 McCormick ..... 128/204.17
5,717,991 A 2/1998 Nozaki et al.
5,819,731 A 10/1998 Dyrud et al.
5,884,336 A * 3/1999 Stout ..... 2/206
6,055,982 A 5/2000 Brunson et al.
6,323,389 B1 11/2001 Thomas et al.
6,338,340 B1 * 1/2002 Finch et al. ..... 128/205.27
6,422,238 B1 7/2002 Lithgow
6,718,982 B1 * 4/2004 Smith et al. ..... 128/207.12
6,868,852 B1 * 3/2005 Gaschke ..... 128/201.13
6,928,657 B1 * 8/2005 Bell et al. ..... 2/9
6,941,949 B1 * 9/2005 Amante et al. ..... 128/206.21

* cited by examiner

DISPOSABLE FACE MASK

CROSS REFERENCE TO RELATED APPLICATIONS

This application is a continuation of U.S. Ser. No. 10/325,262 filed Dec. 19, 2002 now U.S. Pat. No. 6,941,949, entitled "Disposable Face Mask," which is hereby incorporated by reference in its entirety.

BACKGROUND

This invention generally relates to face masks, and more specifically, to face masks used in clean rooms, medical facilities, and so forth.

Disposable and non-disposable face masks have been in use for many years. In the medical field, many early masks were used to prevent contamination and resulting infection of patients, particularly during surgery. In recent years, there has also been an increased awareness and concern for preventing contamination and infection of health care personnel by airborne pathogens, such as the hepatitis B virus. Therefore, it has become necessary to both prevent the spread of infections from patients to health care personnel as well as prevent the spread of infections from health care personnel to patients by inhalation of airborne infectious aerosols and/or particulate matter, or by contamination of a wound or surgical incision by airborne infectious aerosols and/or particulate matter. It has become even more important in view of the advent of human immunodeficiency virus (HIV) and the recent increase in infectious tuberculosis associated with many HIV patients. Accordingly, it is necessary to prevent body fluids, aerosols and/or particulate matter from a person's eyes, nose, mouth, ears, and so forth, from contacting others, to prevent the spread of disease(s).

Aerosols having airborne liquid and, at times solid particles are generated not only by exhalation, but also by certain procedural manipulations and processes that impart energy to any liquid or microbial suspension. By way of example, surgical procedures involving use of drills and saws are particularly prolific producers of aerosols and/or particles which may contain pathogens which infect health care personnel. Patients with compromised and/or suppressed autoimmune systems, as well as patients having open wounds or a surgical incision, must likewise be protected from pathogens which may be spread by aerosols, particulate matter, and so forth, from health care personnel.

Face masks cover a health care personnel's (hereinafter "wearer" or "wearer's") nose and mouth, but not the remaining portion of the wearer's face, i.e., checks, jaw, ears, and so forth. If aerosols and/or particulate matter contact these unprotected areas of the wearer's face, the wearer may be contaminated by such aerosols and/or particulate matter if they contact small cuts, such as shaving nicks, and so forth. On the other hand, facial hair and skin on a wearer's cheeks and jaw are exposed, as are the wearer's ears. A wearer's checks, jaws, and ears, however, have hair, flakes of skin, and so forth that may be shed from the wearer, resulting in potential contamination to a patient, especially to a wound or surgical incision. Moreover, if a wearer sneezes while wearing a traditionally available face mask covering only the nose and mouth, a portion of the expelled aerosol and/or particulate matter from the sneeze emerges from the sides of the face mask. Therefore, a face mask having side panels which extend over the wearer's cheeks, jaw, and ears would be desirable to substantially cover these areas to reduce or eliminate contamination to both patients and health care personnel.

DEFINITIONS

As used herein, the term "pathogen" refers to an agent that causes diseases, including, but not limited to a living microorganism, such as, a bacterium, a fungus, a virus, prions/proteins, and so forth.

As used herein, the term "aerosol" refers to a gaseous suspension of solid and/or liquid particles.

As used herein, the term "particulate matter" refers to a substance formed of separate particles, i.e., one or more particles.

As used herein, the term "fluid" refers to any gas, liquid, or mixture of gas and liquid; various types of aerosols and particulate matter may be entrained with such fluids.

As used herein, the term "repellant agent" refers to an agent that resists absorption of a liquid, desirably an aqueous fluid or liquid. The repellant agent may repel liquids by filling interstitial voids in a porous or fibrous structure of a material or by coating individual fibers thereby preventing liquids from being absorbed by and passing through the fibers to the interior of the structure. The repellant agent may be hydrophobic material and may include such materials, for example, but not by way of limitation, as sizing agents, waxes, and latexes. Furthermore, the repellant agent may be any hydrophobic chemical, such as SCOTCH GUARD®, available from 3M Company, St. Paul, Minn. or other fluorochemicals such as those disclosed in U.S. Pat. Nos. 5,151,321, 5,116,682, and 5,145,727, all of which are incorporated by reference herein in their entirety.

As used herein, the term "couple" includes, but is not limited to, joining, connecting, fastening, linking, or associating two things integrally or interstitially together.

The term "contaminant" shall mean a chemical agent or biological organism/pathogen that can potentially harm a human being or animal; the term "contamination" refers to the act or process of contaminating.

These terms may be defined with additional language in the remaining portions of the specification.

SUMMARY OF THE INVENTION

A disposable face mask includes a mask body covering substantially a nose, mouth, and chin of a wearer, and an extension provided with the mask body. The extension is configured to encircle a back of a wearer's head and to substantially cover a wearer's cheeks, jaw, and ears. A substantial portion of the extension is formed from a resilient material treated with a repellant agent to prevent contaminants from entering or exiting such treated portion of the extension.

DETAILED DESCRIPTION

Figure 1:
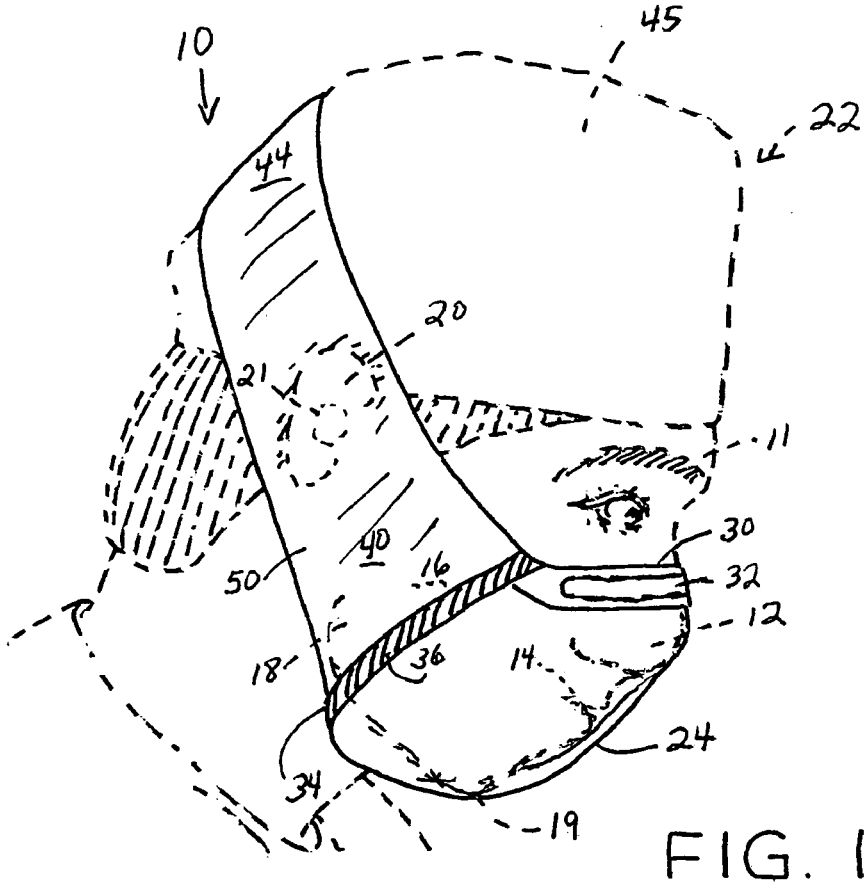
FIG. 1 is a side view of a disposable face mask which is shown being worn by a wearer (illustrated in phantom lines)

Reference will now be made in detail to the presently preferred embodiments of the invention, one or more examples of which are illustrated in the drawings. Each example is provided by way of explanation of the invention and is not meant as a limitation of the invention. For example, features illustrated and described as part of one embodiment or figure can be used on another embodiment or figure to yield yet another embodiment. It is intended that the present invention include such modifications and variations.

Disposable face masks 10, 110, 210 incorporating various features of the present invention may be used to retard or prevent the escape of fluids, particulate matter and/or aerosols from the nose, mouth, ear, ear canal, hair, skin, and so forth, of the wearer. Similarly, the disposable face masks 10, 110, 210 may also provide various features which may be used to retard or prevent fluids, particulate matter and/or aerosols from contacting the skin, mucous membranes, and so forth of a wearer.

The present invention provides a barrier about the nose, mouth, cheeks, jaw and ears of a wearer. The present invention resists the passage of aerosols and/or particulate matter to the wearer while at the same time reducing and/or eliminating aerosols, fluids, 5 and/or particulate matter from the wearer to a patient. The present disposable face mask provides a comfortable fit for extended periods of wear, with easy pull-on/pull-off features. The present invention uses one or more layers of filter media which is desirably specifically designed to block the passage of aerosols, fluids and/or particulate matter.

Figure 2:
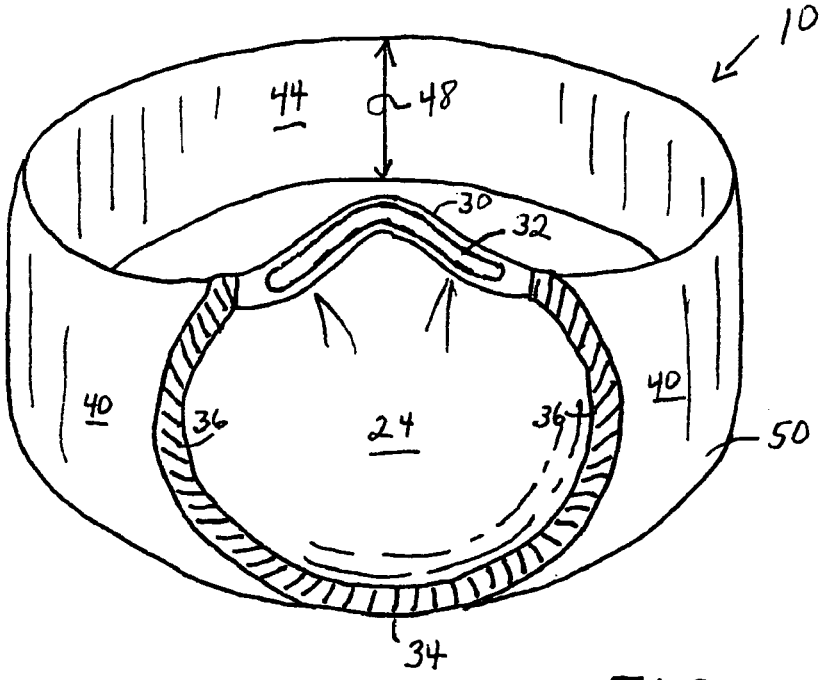
FIG. 2 is a perspective view of the disposable face mask of FIG. 1.
Figure 3:
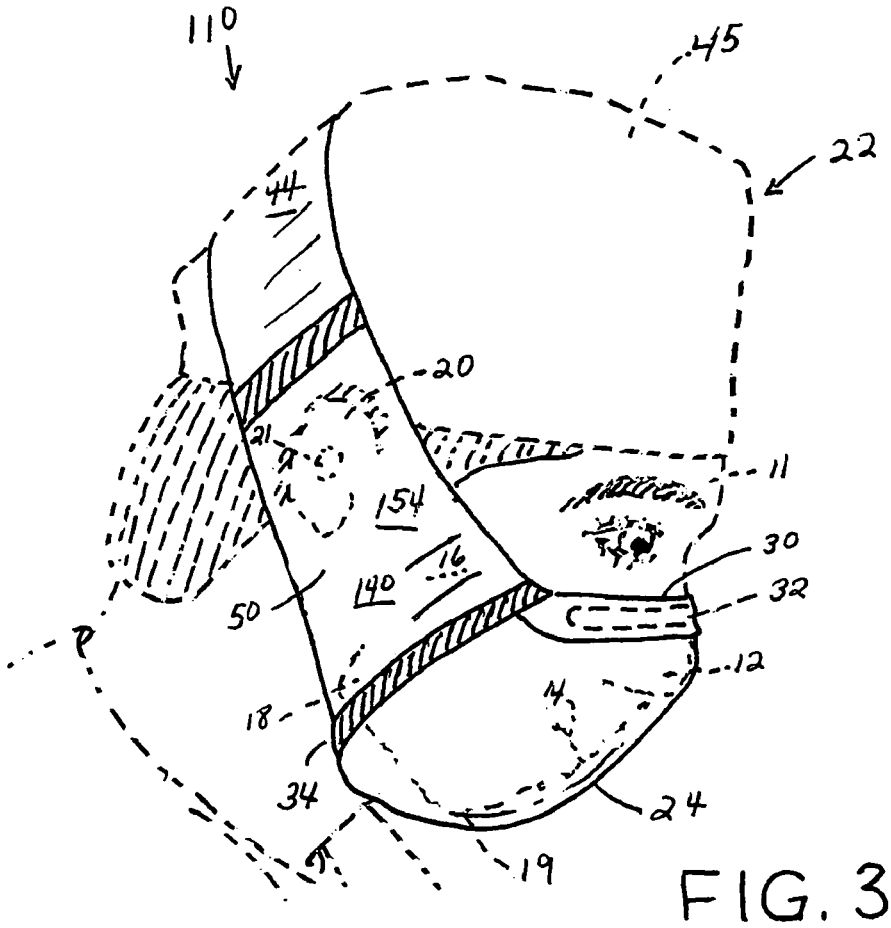
FIG. 3 is a side view of another embodiment of a disposable face mask which is shown being worn by a wearer (illustrated in phantom lines)
Figure 5:
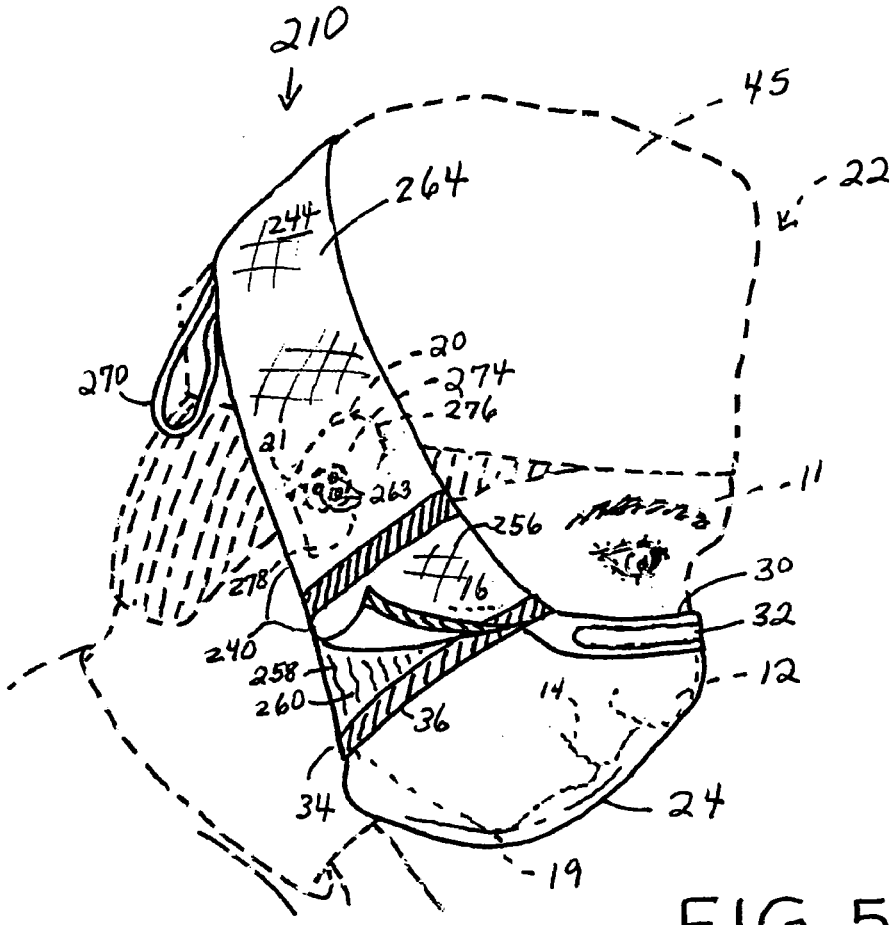
FIG. 5 is a side view of yet another embodiment of a disposable face mask which is shown being worn by a wearer (illustrated in phantom lines)

Turning now to FIGS. 1 and 2, a face mask 10 incorporating some of the features and characteristics of the present invention is illustrated in FIG. 1, and which is positioned over a portion of a wearer's face 11, that is, a wearer's nose 12, mouth 14, cheeks 16, jaw 18, chin 19, and ears 20 and ear openings or canals 21 of a wearer 22 who, along with his features, is illustrated in all FIGS. 1, 3, and 5 (in phantom lines). The face mask 10 includes a mask body 24 which substantially covers the wearer's nose and mouth. As shown in FIGS. 1 and 2, the mask body 24 is generally cone-shaped. This type of mask body provides "off-the-face" benefits while still being easy to stack, package, store and ship. Cone-shaped "off-the-face"-style masks may provide, to some wearers, a larger breathing chamber as compared to soft, pleated masks which may contact more of the wearer's face. Examples of generally cone-shaped masks are disclosed in U.S. Pat. No. 4,536,440 to H. Berg issued Aug. 20, 1985 and U.S. Pat. No. 4,729,371 to Krueger et al., issued Mar. 8, 1988, both of which are incorporated by reference in their entirety. Many cone-style face masks are known and commercially available. Pleated masks may also be utilized in the present invention. Examples of pleated masks are disclosed in U.S. Pat. No. 4,635,628 to Hubbard et al. issued Jan. 13, 1987, U.S. Pat. No. 4,969,457 to Hubbard et al., issued Nov. 13, 1990, and U.S. Pat. No. 4,920,960 to Hubbard et al. issued May 1, 1990, all of which are hereby incorporated by reference in their entirety.

The mask body 24 covers a relatively small portion of the wearer's cheeks 16 but substantially encompasses the wearer's chin 19. A top edge 30 of the mask body 24 may desirably include an elongated malleable member 32. The malleable member 32 is provided so that top edge 30 of mask body 24 can be configured to closely fit the contours of the nose 12 and upper cheeks 16 of the wearer 22. The malleable member 32 is preferably constructed from an aluminum strip with a rectangular cross-section, but may form any suitable configuration, and may also be a moldable or a malleable steel or other metal or alloy, plastic, or any combination thereof. The top edge 30, a lower edge 34, and opposite side edges 36 cooperate to define an outer periphery of the mask body 24.

An extension or a pair of lateral portions 40 are coupled to one of each of the side edges 36 by the use of various adhesives, ultrasonic seals (sometimes referred to as ultrasonic welds), heat seals, and so forth. Alternatively, the lateral portions 40 are provided in a unitary construction along with the mask body 24 (not shown).

Lateral portions 40 are formed from a resilient material, such as, by way of non-limiting example, an elastic or elastomeric synthetic or natural material such as spandex. One commercial example of spandex includes LYCRA®, available from DuPont Apparel & Textile Science, Wilmington, Del. Other commercially available spandex materials include VYRENE®, DORLASTAN®, SPANZELLE®, GLOSPAN®, and so forth. An example of a natural material for forming an elastic or elastomeric material is natural rubber. Any stretchable nylon, polyester (double knit, circle knitted, and so forth) product, and other known commercially available resilient materials may also be used.

Another product is which may be used, alone or in combination with any of the afore-mentioned materials in providing the lateral portions 40, or any portion of the mask 10, is a continuous feed spun bonded laminate (hereinafter "CFSBL") having improved elastic properties measured at body temperature. This laminate has at least one first and second nonelastic layers between which is sandwiched at least one elastic layer. The elastic layer is comprised of a triblock polystyrene-poly(ethylene/propylene)-polystyrene ("SEPS") copolymer having a number average molecular weight of about 81,000 g/mol. The weight percent of styrene is approximately 18% and the weight percent of ethylene/propylene is approximately 82%. The molecular weight increase in the EP block, while holding the molecular weight of the styrene block constant, increases the entanglement density, polymer chain persistence length and the relaxation time. The resulting laminate load decay rate and load loss measurements over a period of 12 hours at body temperature shows marked improvement over known CFSBL product. The laminate is used currently as side panel material in training pants because of the resistance of the laminate to sagging at body temperature. The CFSBL laminate described above is disclosed in U.S. Pat. No. 6,323,389 to Ooman et al., which is hereby incorporated by reference in its entirety herein. However, any one of the foregoing materials, or any combination of these materials, may be used to provide the lateral portions 40 and/or at least a portion of the mask body 24.

Figure 6:
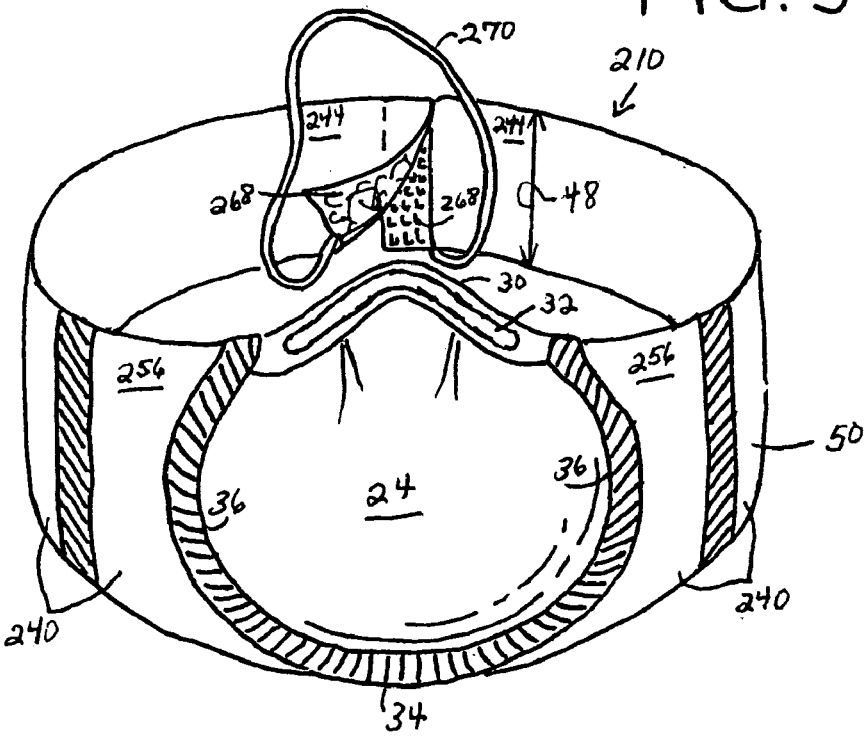
FIG. 6 is a perspective view of the disposable face mask of FIG. 5.

Lateral portions 40 may be constructed to as a single unitary extension (FIGS. 1–4) or may provide two separate lateral portions (FIGS. 5–6). In the present embodiment, the lateral portions 40 include a central portion 44 which connects one lateral portion 40 to the other, thereby providing a continuous circle of material which extends from near one side edge 36 of the mask body 24, around a wearer's head 45 back to an opposite side edge 36 of the mask body 24. The central portion 44 extends across a back of the wearer's head 45 and it is also desirably formed at least partially from a resilient material. The central portion 44 has sufficient resiliency to permit the mask body 24 and lateral portions 40 to be positioned comfortably but firmly over the wearer's face 11, that is, the wearer's nose 12, mouth 14, cheeks 16, jaw 18, chin 19, ears 20, and so forth, as illustrated in FIG. 1.

The central portion 44 may also have a width 48 in a range of about 0.10 inch (0.25 cm) to about 3.0 inches (7.6 cm). Further, the central portion 34 may have a width 48 in a range of about 0.20 inch (0.5 cm) to about 2.5 inches (6.3 cm). In addition, the central portion 34 may have a width 48 in a range of about 0.30 inch (0.76 cm) to about 2.25 inches (5.7 cm). Moreover, the central portion 44 may have a width 48 in a range of about 0.3 inch (0.76 cm) to about 2.0 inches (5.0 cm).

The exterior surface 50 of the mask 10 and/or any portion(s) thereof, may desirably be treated with a repellant agent to repel fluids, such as blood, and so forth, from wicking into the mask 10. Such treatment with repellent agent(s) include, but are not limited to, fluorochemical coatings and/or treated materials such as those described in U.S. Pat. Nos. 5,151,321, 5,116,682, and 5,145,727, all of which have been previously incorporated by reference herein. Another flurochemical which may be used to treat one or more surfaces of the mask 10 is SCOTCHGUARD®, available from 3M Company, St. Paul, Minn.

Figure 4:
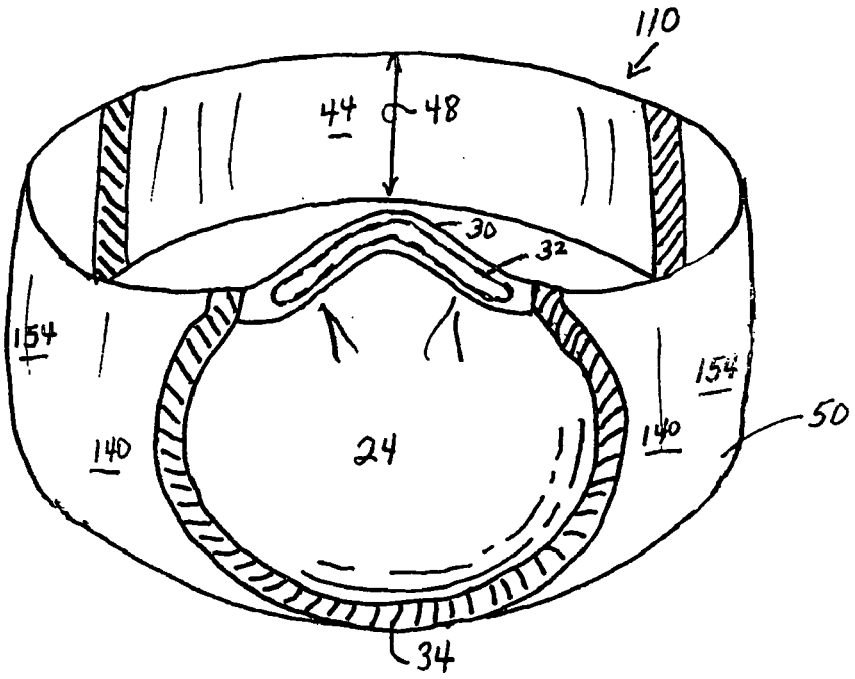
FIG. 4 is a perspective view of the disposable face mask of FIG. 3.

In another embodiment of the invention, as illustrated in FIGS. 3 and 4, the disposable mask 110 is similar to the disposable mask 10 shown in FIGS. 1 and 2 and previously described in detail herein. Each lateral portion 140 of the mask includes a pair of hearing panels 154 which cover the ears 20 of the wearer 22.

Each hearing panel 154 includes a resilient material, that is, a material having a relatively lighter basis weight and/or lighter weave or structure, such as, for example, a lighter weight, i.e., basis weight and/or weave of spandex, nylon/elastomeric material, CFSBL, and so forth. In addition, the hearing panels 154 may have one or more small apertures (FIG. 5) to facilitate the wearer's hearing while still providing substantial coverage over the wearer's ears 20. It will be appreciated that one or any combination of these features may be used.

In another embodiment of the invention, as illustrated in FIGS. 5 and 6, the disposable mask 210 is similar to the disposable mask 10 and 110 and shown in FIGS. 1 and 2, and 3 and 4, respectively, and previously described in detail herein. Each lateral portion 240 is a separate portion, and includes free ends 256 which couple together.

In addition, each lateral portion includes a section 256 which desirably comprises a barrier material 260. The barrier material 260 in the present embodiment is positioned below outer resilient material, which is shown lifted partially away in FIG. 5 for illustrative purposes only. However, the barrier material 260 may be provided in each section 256 or, alternatively a barrier material may be provided in any portion of the mask body 24, and/or any or all of each lateral portion 240 of the mask 210. The barrier material 260 will desirably be positioned so that aerosols, fluids, and/or particulate matter contacting the mask 10 from the outside will be repelled. It will be understood that the barrier material may be positioned on any inner or outer surface of the mask, or in any layer intermediate to an inner or outer surface.

The barrier material 260 is capable of differentiating between gases and liquids and may be, for example, Visqueen Film Products' low density polyethylene, Vispore X-6212. Non-wetting materials, such as those used to form the barrier material, have small apertures which prevent liquids with a relatively high surface tension from passing therethrough yet will allow gases with a low surface tension to pass therethrough. It is preferable to have the apertures as large as possible to allow easy breathing, and yet small enough to retard or prevent the flow of liquids. The barrier material 260 is designed to freely pass gases in either direction, while restricting the passage of liquids in at least one direction. The sections 256 of the lateral portions 240 shown in FIGS. 5 and 6 are constructed with the barrier material 260 positioned to restrict liquid passage from the exterior of mask 210, although it will be appreciated that additional barrier materials 260 may be positioned in other orientations as well. Further description of the construction and operation of such barrier material may be found in U.S. Pat. No. 3,929,135 to Thompson, and U.S. Pat. No. 6,055,982 to Brunson et al., both of which are incorporated by reference in their entirety herein.

The barrier material 260 may include a layer which may be positioned adjacent thereto which is preferably a filtration media, which may be, for example, melt blown polypropylene or polyester. The filtration media may be provided to inhibit the passage of airborne bacteria in either direction which will prevent passage of germs to and from the wearer 11. In addition, the barrier material 260 may further include an inner layer which contacts the face of the wearer 11. Such an inner layer is desirably constructed of a light weight, highly porous, softened, non-irritating, non-woven fabric, such as Dexter, Inc. product No. 3768. Such an inner layer is designed to prevent unwanted materials such as facial hair, loose fibers or perspiration from contacting the barrier and other layers which might cause a wicking effect to draw liquids through any section, lateral portion and/or the mask body. The inner layer may provides a comfortable surface for contact with the face of the wearer 11. By requiring fluids to pass through more than one layer to contact a wearer, the fluid will have less pressure and the barrier material 260 will be better able to prevent passage of the fluid.

The barrier material 260 is desirably gathered or pleated and coupled to the mask body 24 and/or the lateral panels 240 by any means disclosed herein or known in the art. Such gathering and pleating permits the barrier material 260 to extend over the wearer's face 11 and it will therefore not inhibit the stretch of the resilient material forming the lateral portions 240 which covers the wearer's face 11. Exemplary barrier materials include, but are not limited to, those disclosed in U.S. Pat. No. 4,635,628 to Hubbard et al. issued Jan. 13, 1987, U.S. Pat. No. 4,969,457 to Hubbard et al., issued Nov. 13, 1990, and U.S. Pat. No. 4,920,960 to Hubbard et al. issued May 1, 1990, all of which are hereby incorporated by reference in their entirety.

In addition, each lateral portion 240 includes one or more small apertures 263 positioned generally over the canal 21 in each ear 20 of the wearer 22, as shown in FIG. 5. These apertures 263 are positioned to facilitate the hearing of the wearer.

In the present embodiment, the lateral panels 240 have free ends 268 in the central portion 244 which include connectable sections 264 thereon, as shown in FIG. 6. One or more fasteners or connectable sections 264 releasably couple together, to provide further adjustability to ensure for a comfortable yet firm fit of the mask 210. The connectable sections 264 are provided to releasably couple or connect over the back of the wearer's head 50 by use of commercially available hook and loop material, snaps, buttons and button holes, mechanical hooks and loops, adhesives, including cohesive adhesives, pressure sensitive adhesives, and so forth, disposed on a portion of each free end 268 to provide each connectable section 264.

A connector cord 270 is attached to each connectable section 264 on or near each free end 268, and it extends therebetween. The connector cord 270 facilitates removing the mask 210 but allows the mask to hang around the wearer's neck (not shown). The connector cord 270 may be a strap, a string, and/or a cord constructed from a non-elastomeric material, or it may be constructed from any suitable elastomeric material, and desirably, by way of non-limiting example, rubber, elastic covered yarn, an elastomeric material wrapped with nylon or polyester, and so forth.

It will be understood that each mask 10, 110, 210 is positioned over a portion of a wearer's face 11, that is, a wearer's nose 12, mouth 14, cheeks 16, jaw 18, chin 19, and ears 20. Further, each ear, that is, the lateral surface 274 thereof, is substantially covered, as is the opening 21 of each ear 20. Desirably, each ear 20 is substantially covered by one of the lateral portions 40, 140, 240 from the uppermost portion 276 of the ear 20 to the lowermost portion or end of the ear lobe 278.

It will be appreciated that the mask 10, 110, 210, and any portions thereof, may be made substantially from the same material(s). The mask may be constructed as a substantially unitary mask; alternatively, the mask may include any number of sections in any location thereon. In addition, any portion of the mask, such as the mask body, the lateral panels, and/or the central portion, may include one or more sections therein, made from one or more materials.

It will be appreciated that any of the features shown and/or described herein may be used with any mask 10, 110, 210 herein in any combination. While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A disposable face mask, comprising:

a mask body configured to substantially cover at least a nose and mouth of a wearer; and an extension provided with the mask body, the extension configured to encircle a back of a wearer's head, wherein the extension includes two separate lateral panels which extend to a back of a wearer's head, each of the two separate lateral panels including a connectable section on each free end thereof, each connectable section configured to be releasably coupled together at a back of a wearer's head, wherein one end of a connector cord is connected adjacent one free end of one lateral panel and an opposite end of the connector cord is connected adjacent another free end of another lateral panel, such that when the two connectable sections are un-coupled and released from each other, the face mask moves from a wearer's face downward toward a front of a wearer's neck and is held about a wearer's neck by the connector cord's connection between the two lateral panels.

2. The disposable face mask of claim 1, wherein the connector cord includes an elastomeric material.

3. The disposable face mask of claim 1, wherein at least the mask body includes a barrier material.

4. The disposable face mask of claim 1, wherein at least a portion of the face mask includes CFSBL.

5. The disposable face mask of claim 1, wherein each connectable section includes one of a hook and a loop material.

6. The disposable face mask of claim 1, wherein each connectable section includes an adhesive.

7. The disposable face mask of claim 1, wherein each connectable section is selected from the group consisting of snaps, buttons and button holes, and mechanical hooks and loops.

8. A disposable face mask, comprising:

a mask body configured to substantially cover a nose and mouth, of a wearer, at least a portion of the mask body including a barrier material; and an extension provided with the mask body, the extension including two lateral panels, each of the lateral panels being coupled to a portion of the mask body, the lateral panels configured to cooperate to encircle a back of a wearer's head when connected together, each lateral panel including a connectable section on each free end, each connectable section configured to be releasably coupled together at a back of a wearer's head, wherein one end of a connector cord is connected to one lateral panel and an opposite end of the connector cord is connected to another lateral panel, such that when the two connectable sections are un-coupled and released from each other, the face mask moves from a wearer's face downward toward a front of a wearer's neck and is held about a wearer's neck by the connector cord's connection between the two lateral panels.

9. The disposable face mask of claim 8, wherein the connector cord includes an elastomeric material.

10. The disposable face mask of claim 8, wherein at least a portion of the face mask includes CFSBL.

11. The disposable face mask of claim 8, wherein each connectable section has one of a hook and a loop material.

12. The disposable face mask of claim 8, wherein each connectable section is selected from the group consisting of snaps, buttons and button holes, and mechanical hooks and loops.

13. The disposable face mask of claim 8, wherein each connectable section includes an adhesive.

14. The disposable face mask of claim 13, wherein the the adhesive includes a pressure sensitive adhesive.

15. The disposable face mask of claim 13, wherein the adhesive includes a cohesive adhesive.

* * * * *